US007775692B2

(12) United States Patent
Li

(10) Patent No.: US 7,775,692 B2
(45) Date of Patent: Aug. 17, 2010

(54) LED STREET LAMP

(75) Inventor: Xuliang Li, Dongguan (CN)

(73) Assignee: Dongguan Kingsun Optoelectronic Co., Ltd, Hengjiangxia Village, Changping Town, Dongguan (CN)

( * ) Notice: Subject to any disclaimer, the term of this patent is extended or adjusted under 35 U.S.C. 154(b) by 100 days.

(21) Appl. No.: 12/189,792

(22) Filed: Aug. 12, 2008

(65) Prior Publication Data

US 2009/0046449 A1 Feb. 19, 2009

(30) Foreign Application Priority Data

Aug. 13, 2007 (CN) ..... 2007 2 0122243 U

(51) Int. Cl.
*F21S 8/00* (2006.01)

(52) U.S. Cl. ..... 362/431; 362/249.01; 362/249.02

(58) Field of Classification Search ..... 362/431, 362/249.01, 249.02
See application file for complete search history.

(56) References Cited

U.S. PATENT DOCUMENTS

| | | | | |
|---|---|---|---|---|
| 7,090,370 | B2 * | 8/2006 | Clark et al. | 362/183 |
| 7,278,761 | B2 * | 10/2007 | Kuan | 362/294 |
| 2007/0195527 | A1 * | 8/2007 | Russell | 362/240 |
| 2008/0285265 | A1 * | 11/2008 | Boissevain | 362/218 |
| 2008/0298051 | A1 * | 12/2008 | Chu | 362/183 |

* cited by examiner

*Primary Examiner*—Sandra L O'Shea
*Assistant Examiner*—Evan Dzierzynski

(57) ABSTRACT

The present invention relates to a LED street lamp, and more particularly to LED street lamp which is easy to maintenance. The LED street lamp comprises street lamp pole, lamp body and LED bulbs, said lamp body is mounted on the top of said street lamp pole, said LED bulbs is mounted in said lamp body, wherein the LED street lamp further comprises Power supply adapter and constant current actuating device, said Power supply adapter is mounted at the bottom of said street lamp pole, said constant current actuating device is mounted in said lamp body. The LED street lamp involved in the present invention is easy to maintenance.

1 Claim, 6 Drawing Sheets

LED STREET LAMP

BACKGROUND OF THE INVENTION

1. Field of the Invention

The present invention relates to a LED street lamp, and more particularly to a LED street lamp which is easy to be maintained.

2. Description of the Prior Art

Typically, the ordinary street lamp is high-pressure sodium lamp. In addition to the switch button, other parts of the street lamps are mounted on the top of the street lamps pole. Once the street lamp went wrong or needed maintenance, serviceman would be send to high place to maintain the street lamp by special crane or elevator. Maintenance is very difficult, long cycle and high costs. Compared with the high-pressure sodium lamp, LED Street lamp has good chroma, and needs no maintenance with a long service life. It is more energy-saving. In the traditional conception, equipment like power supply adapter are mounted in lamp body, therefore, although LED bulb has a long service life itself, the top of the LED street lamp still need maintenance just because of power supply adapter, the costs of maintenance is high and maintenance is discommodious. On the other hand, power supply adapter is calorifacient, so it adds to the burden of the lamp body's heat emanation. That then reduces the service life of the power supply adapter also.

SUMMARY OF THE INVENTION

An object of this invention is to provide an LED street lamp which is effective heat emanation and easy to maintenance for overcoming the aforementioned disadvantage.

The present invention can be achieved by following technical solutions: An LED street lamp comprises street lamp pole, lamp body and LED bulbs, said lamp body is mounted on the top of said street lamp pole, said LED bulbs is mounted in said lamp body, wherein the LED street lamp further comprises a power supply adapter and a constant current actuating device, said power supply adapter is mounted at the bottom of said street lamp pole, said constant current actuating device is mounted in said lamp body.

An LED street lamp, wherein said LED bulbs comprise several working modules, every said working module is connected with an independent constant current actuating device.

An LED street lamp, wherein the LED street lamp further comprises an over heat thermostat mounted in said lamp body, said over heat thermostat is mounted between the output of said power supply pdapter and the input of constant current actuating device.

An LED street lamp, wherein the lamp body comprises a head portion, a middle portion and a tail portion; said head portion and one side of said middle portion are connected butt and butt, and the opposite side of said middle portion and said tail portion are connected the same; a first packing washer is provided between the head portion and the middle portion, and the head portion and the middle portion are secured by fasteners; a second packing washer is provided between the tail portion and the middle portion, and the tail portion and the middle portion are secured by fasteners; the middle portion is a profile, it has the same cross section in the different position along its length direction, and said profile consists of a basal plate, said basal plate is tabulate, said basal plate extends along the direction of the length of said profile, said basal plate has two sides: a back side and the front side; two side plates are respectively mounted on the two edges of said front side, there are some heat dissipation wings mounted on said back side; LED bulbs are mounted on a side of said heat conducting bottom-board, which form LED array board, printed circuit is mounted on said heat conducting bottom-board, the another side of said heat conducting bottom-board which has no LED bulb is clinged to said front side of said basal plate of middle portion of said lamp body; the LED street lamp also comprises secondary optical lens, said secondary optical lens is mounted on said lens bottom-board with bottom stand, said lens bottom-board is parallel to LED array board, every said LED bulb is corresponding to one said secondary optical lens, there are some support units which have the same height mounted on the side of said lens bottom-board which faces to LED array board, said heat conducting bottom-board is supported by said support units, said lens bottom-board and said heat conducting bottom-board are connected to the front side of said basal plate with the screw; first cross member is mounted on said head portion, said first member is mounted on the end of said head portion of said bomb body which is connected to said middle portion; second cross member is mounted on the tail portion, said second cross member is mounted on the end on said tail portion 103 of said lamp body which is connected to said middle portion; said first cross member, second cross member, said two side plates which are on the two edges of the front side of said middle portion, and the front side of said middle portion define a enclosure together, the front side of said middle portion forms the bottom of said enclosure, said first cross member, second cross member, and said two side plate which is mounted on the two edge of the front side of said middle portion form the four walls of said enclosure, a step used to place a lamp-chimney is mounted on the other end of the four walls of the enclosure which is opposite to the bottom; a length of tube is mounted on said head portion, the axis of said tube is vertical to said first cross member, a outlet hole leading into said tube is mounted on said first cross member, a threaded hole running through the tube wall is mounted on the side wall of said tube, said head portion, middle portion, and tail portion are all made of heat-conducting material, said LED street lamp also comprises a lamp-chimney, said lamp-chimney is mounted on said step, a third packing washer is mounted between said lamp-chimney and lamp body, LED array board comprises several LED subsidiary array boards, a team of LED lamps are mounted on every LED subsidiary array board, every LED subsidiary array board is connected on the front side of said base board of middle portion 102 with fastener, correspondingly, lens bottom-board also comprises several subsidiary lens bottom-boards, a team of secondary optical lenses are mounted on every subsidiary lens bottom-board, every subsidiary lens bottom-board is connected on the front side of said base board of middle portion with fastener; said constant current actuating device is mounted on the middle portion closer to the head portion of the lamp body, the over heat thermostat composes a thermosnap mounted on the heat conducting bottom-board.

The theoretic service life of LED bulb is more than one hundred thousands hours, and constant current actuating device work in low-voltage, therefore, in the life cycle of LED street lamp, LED bulb and constant current actuating device would not went wrong almost. In the present invention, the LED bulb and the constant current actuating device are mounted in the lamp body which is on the top of the lamp pole, the power supply adapter is mounted at the bottom of the street lamp pole. We can mount a chest at the bottom of the street lamp pole, the power supply adapter is mounted in the chest, when something is wrong, we can open the chest and then maintain the power supply adapter; Compared with traditional technique, maintenance become more convenient and fast, cost of maintenance is lower also. Moreover, there are advantages as following: 1. Power supply adapter is calorifacient, so it is mounted separately to reduce the burden of the lamp body's heat emanation, thereby prolong the service life of the LED street lamp. 2. Accordingly, the service life of the power supply adapter is prolonged also. 3. Compared with the LED bulb, the service life of the power supply adapter is shorter, so it is more convenient for maintenance.

DETAILED DESCRIPTION OF THE INVENTION

The present invention now could be described more fully hereinafter with reference to the accompanying drawings.

Figure 1:
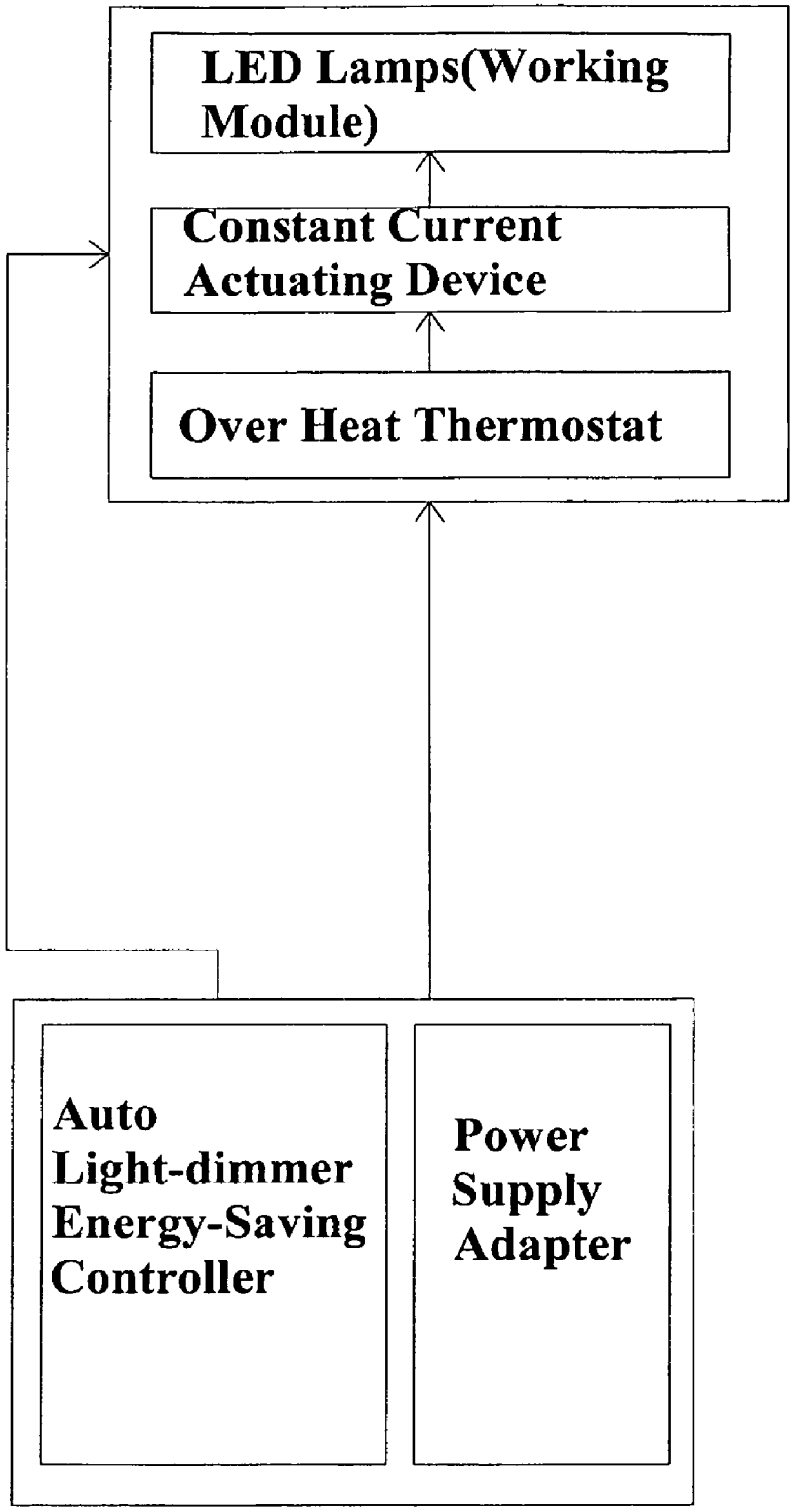
FIG. 1 is function block diagram of a first embodiment of the invention.
Figure 2:
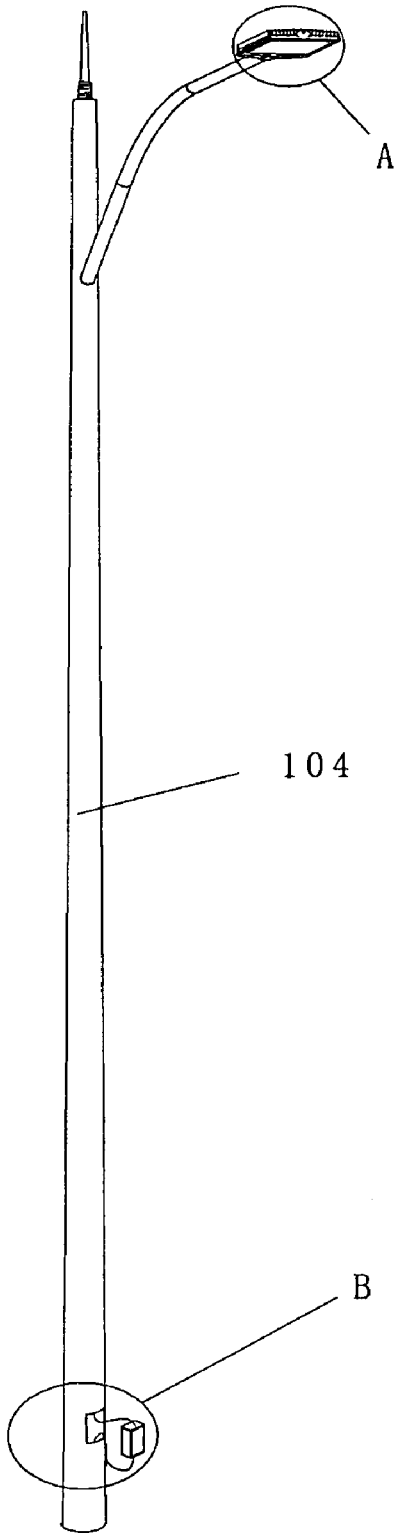
FIG. 2 is a three-dimensional view of the first embodiment of the invention.
Figure 3:
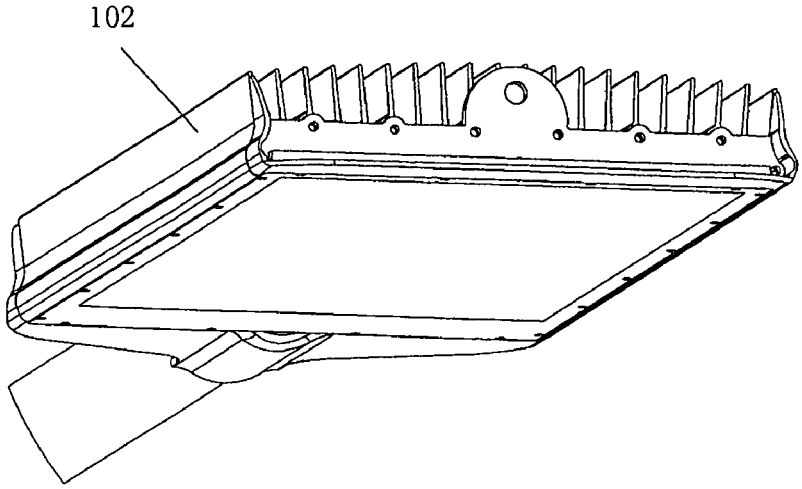
FIG. 3 is an enlarged view of A-A in FIG. 2.
Figure 4:
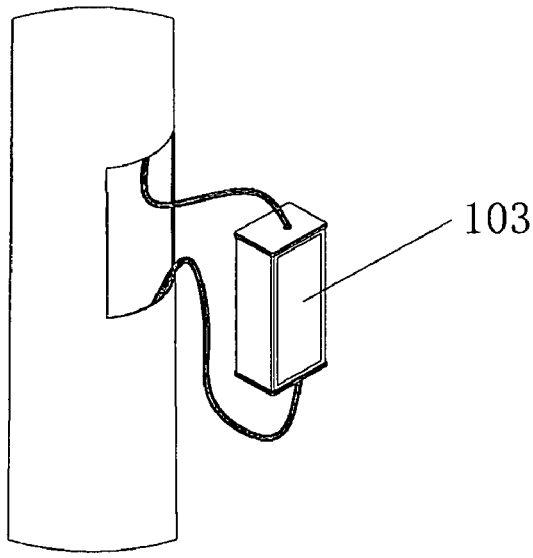
FIG. 4 is an enlarged view of B-B in FIG. 2.
Figure 5:
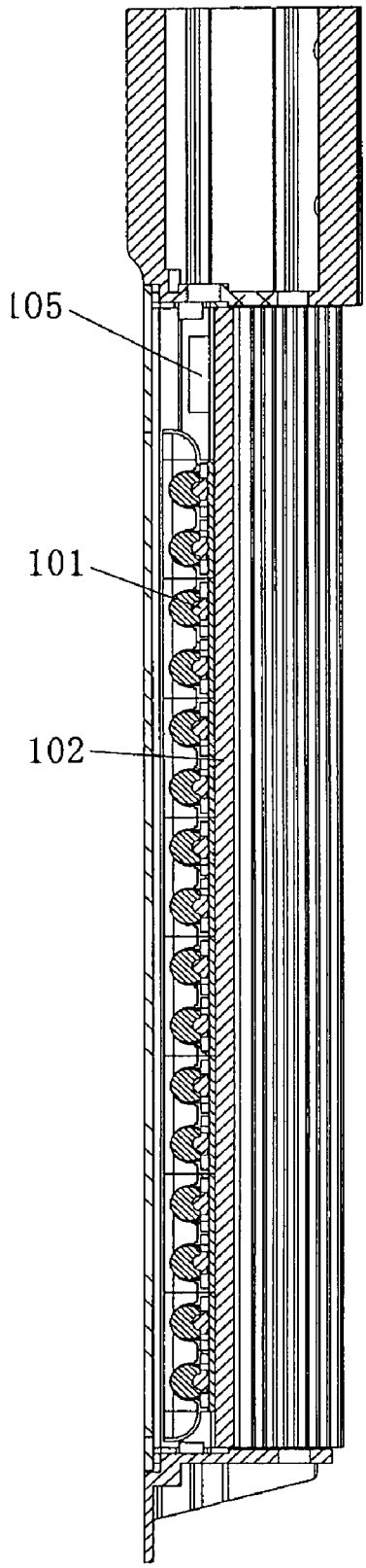
FIG. 5 is a sectional view of lamp body in $1^{st}$ embodiment of the invention.
Figure 6:
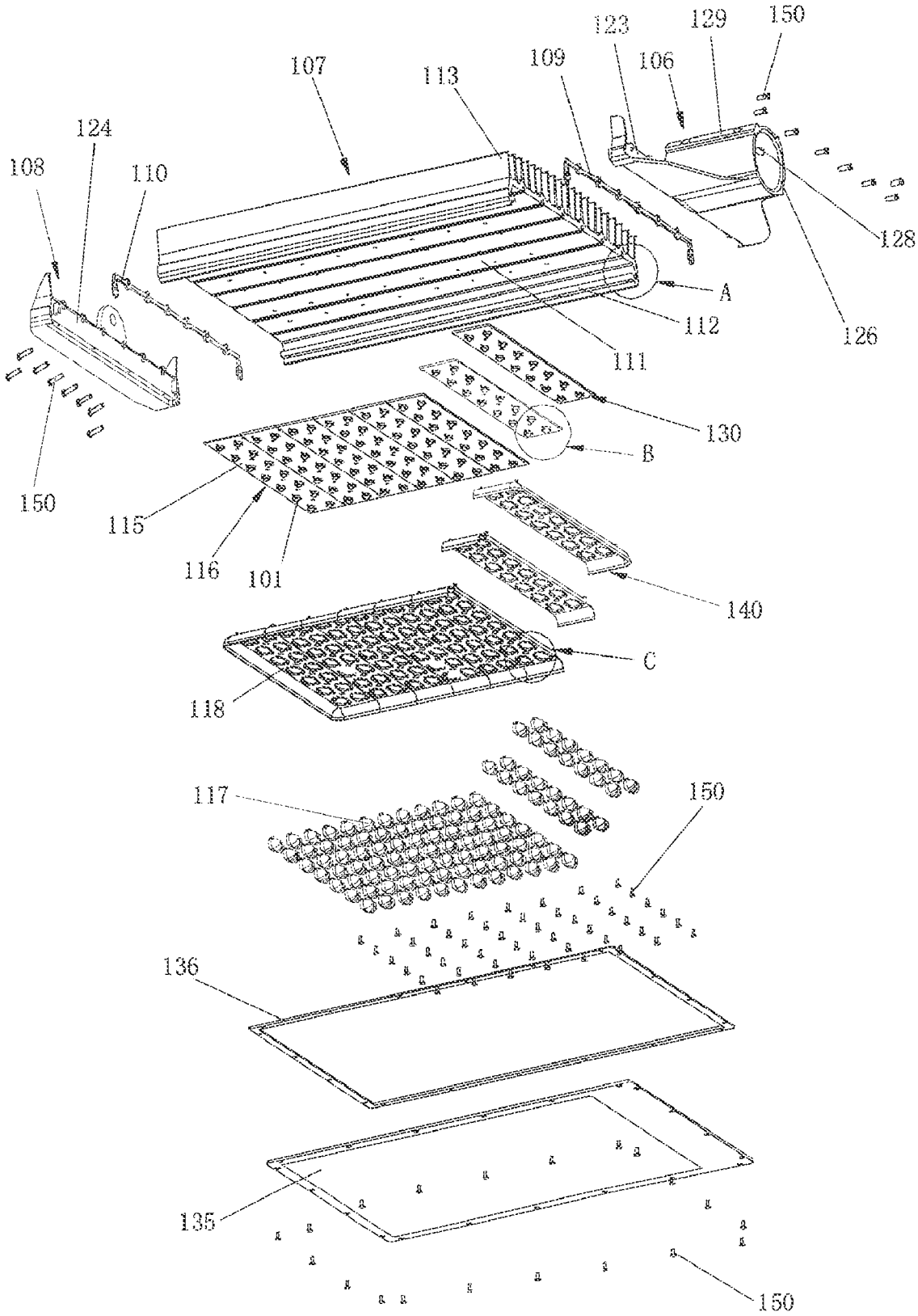
FIG. 6 is an exploded view of the lamp body illustrated in FIG. 5.
Figure 7:
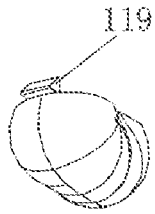
FIG. 7 is an enlarged view of the secondary optical lens illustrated in FIG. 6.
Figure 9:
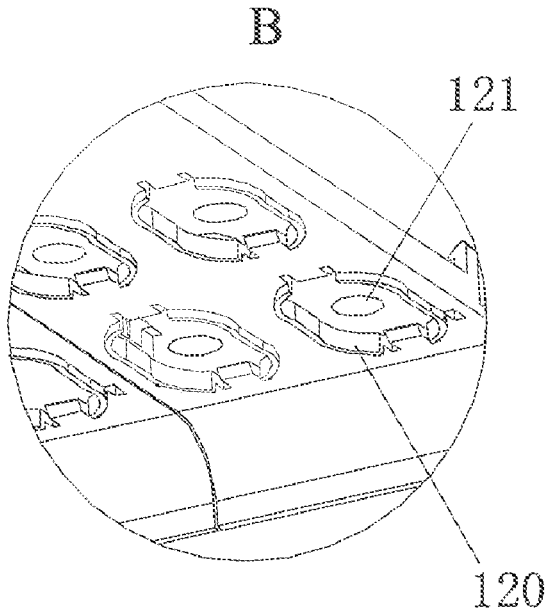
FIG. 9 is an enlarged view of B area illustrated in FIG. 6.
Figure 8:
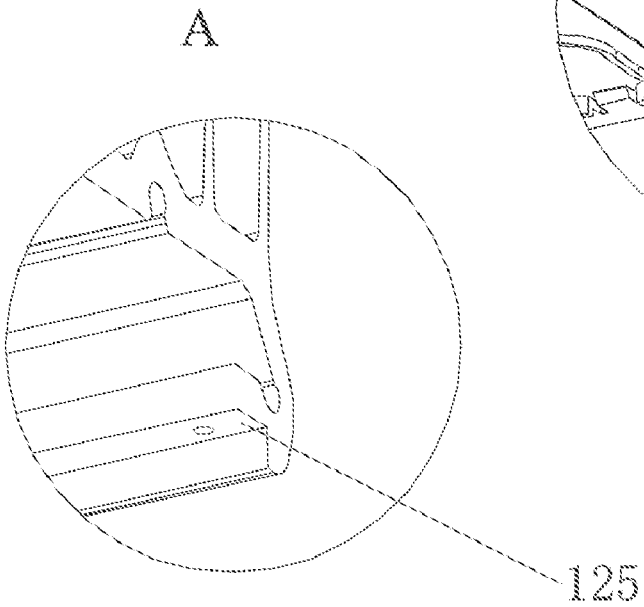
FIG. 8 is an enlarged view of A area illustrated in FIG. 6.
Figure 10:
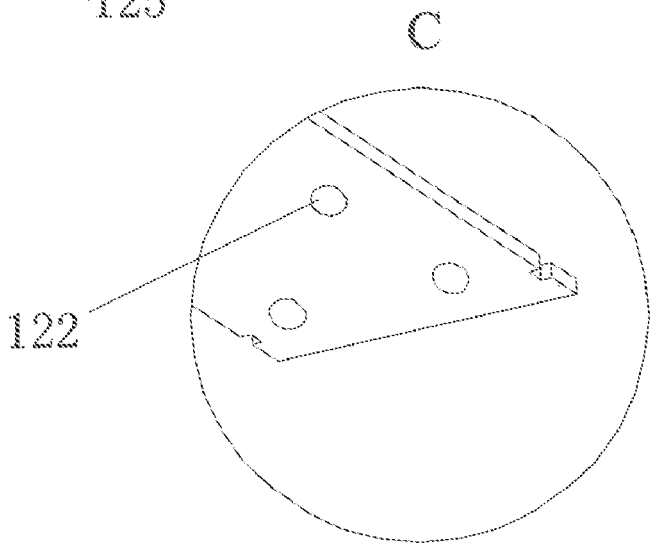
FIG. 10 is an enlarged view of C area illustrated in FIG. 6.

A first embodiment of the invention is a LED street lamp. Referring to FIGS. 1-10, the LED street lamp comprises street lamp pole 104, lamp body 102 and LED bulbs 101, said lamp body 102 is mounted on the top of said street lamp pole 104, said LED bulbs 101 is mounted in said lamp body 102, wherein the LED street lamp further comprises power supply adapter 103 and constant current actuating device 105, said power supply adapter 103 is mounted at the bottom of said street lamp pole 104, said constant current actuating device 105 is mounted in said lamp body. The lamp body 102 comprises a head portion 106, a middle portion 107 and a tail portion 108; said head portion 106 and one side of said middle portion 107 are connected butt and butt, and the opposite side of said middle portion 107 and said tail portion 108 are connected the same; a first packing washer 109 is provided between the head portion 106 and the middle portion 107, and the head portion 106 and the middle portion 107 are connected by screw 150; a second packing washer 110 is provided between the tail portion 108 and the middle portion 107, and the tail portion 108 and the middle portion 107 are connected by screw 150; the middle portion 107 is a kind of section bar, it has the same cross section in the different position along its length direction, said profile consists of a basal plate 111, said basal plate is tabulate, said basal plate extends along the direction of the length of said profile, said basal plate has two sides: the front side and the back side; two side plates 112 are each mounted on the two edges of said front side, there are some heat dissipation wings 113 mounted on said back side; LED bulbs 101 are mounted on a side of said heat conducting bottom-board 115, the LED bulbs and the heat conducting bottom-board form LED array board 116, printed circuit is mounted on said heat conducting bottom-board 115, the other side of said heat conducting bottom-board 115 which has no LED bulbs 101 is clinged to said front side of said basal plate 111 of middle portion 107 of said lamp body 102; the LED street lamp also comprises secondary optical lens 117, said secondary optical lens 117 is mounted on said lens bottom-board 118 with bottom stand 119, said lens bottom-boar 118*d* is parallel to LED array board 116, every said LED bulb 101 is corresponding to one said secondary optical lens 117, there are some support units 120 which have the same height mounted on the side of said lens bottom-board 118 which faces to LED array board 116, said support units 120 are cylinder in this embodiment, there is a through hole 121 mounted in the hub of said cylinder 120, there is also a hole 122 on the part of said heat conducting bottom-board 115 which is corresponding to the through hole 121 of said cylinder, the above-mentioned two holes are used for setting the screw 150. There is a counterbore mounted on the part which is opposite to said support unit 120 of the other side of said lens bottom-board 118, it is used for immersing the head of the screw 150, said support units 120 are contacted with said heat conducting bottom-board 115 and said lens bottom-board 118, said heat conducting bottom-board 115 is connected to the front side of said basal plate 112 with the screw 150; a first cross member 123 is mounted on said head portion 106, said first cross member 123 is mounted on the end of said head portion 106 of said lamp body 102 which is contacted with said middle portion 107; a second cross member 124 is mounted on the tail portion 108, said second cross member 124 is mounted on the end of said tail portion 108 of said lamp body 102 which is contacted with said middle portion 107; said first cross member 123, second cross member 124, said two side plates which are on the two edges of the front side of said middle portion 107, and the front side of said middle portion 107 define a enclosure together, the front side of said middle portion 107 forms the bottom of said enclosure, said first cross member, second cross member, and said two side plates which are mounted on the two edges of the front side of said middle portion 107 form the four walls of said enclosure, a step 125 used to place a lamp-chimney 135 is mounted on the other end of the four walls of the enclosure, a long tube 126 is mounted on said head portion 106, the axis of said tube is vertical to said first cross member 123, a outlet hole 127 leading into said tube 126 is mounted on said first cross member 123, a threaded hole 128 used to lock the LED street lamp on the lamp standard runs through the tube wall, In this embodiment, protuberant arris 129 is mounted on the ektexine of said tube 126, said protuberant arris 129 is mounted along the axis, said threaded hole 128 is mounted on said protuberant arris 129. Said head portion 106, middle portion 107, and tail portion 108 are all aluminum which has good heat-conducting property. Said LED street lamp also comprises lamp-chimney 135, said lamp-chimney 135 is mounted on said step 125, a third packing washer 136 is mounted between said lamp-chimney 135 and said lamp body 102. LED array board 116 comprises several LED subsidiary array board 130, a team of LED bulbs 101 are mounted on every LED subsidiary array board 130, and every LED subsidiary array board 130 is connected on the front side of said basal plate of middle portion 107 with screw 150. The LED bulbs mounted on every LED subsidiary array board compose a LED working module; correspondingly, lens bottom-board 118 also comprises several subsidiary lens bottom-boards 140, a team of secondary optical lenses 117 are mounted on every subsidiary lens bottom-board 140, every subsidiary lens bottom-board 140 is connected on the front side of said basal plate of middle portion 107 with screw 150. The LED lamps mounted on every LED subsidiary array board compose a LED working module, LED street lamp also comprises constant current actuating device 105, said constant current actuating device 105 is mounted in the close enclosure formed by the lamp body 102 and lamp-chimney 135, several teams of independent constant current actuating devices 105 are mounted on the end of said middle portion which is close to said head portion 106, the output of every constant current actuating device 105 are connected with the corresponding LED subsidiary array board by the wire, said constant current actuating device 105 is used to supply power for the corresponding LED working module, said every team constant current actuating device 105 have a common input end, said input end is connected to power supply adapter by the wire. Said constant current actuating device 105 is mounted on the middle portion 107 of the lamp body 102, the temperature sensor of the over heat thermostat is mounted on the heat conducting bottom-board, said over heat thermostat is mounted between the output of said power supply adapter 103 and the input of constant current actuating device 105.

The second embodiment of this invention is also a LED street lamp, Compared with the first embodiment of this invention, one difference is the middle portion 107 of the lamp body 102 is longer; correspondingly, the head portion 106 and the tail portion 108 are connected tensely by bolt. The bolt is mounted in the gap between the heat dissipation wings 113. Another difference is that two LED subsidiary array board are connected to every constant current actuating device 105, this constant current actuating device is used to supply power for two LED working module.

In the aforesaid two embodiments, constant current actuating device 105 and LED lamp are mounted in lamp body on the top of the street lamp pole; power supply adapter 103 is mounted at the bottom of the street lamp pole. Therefore, maintenance of power supply adapter become convenient, compared with traditional technique, maintenance is easier.

What is claimed is:

1. An LED street lamp, comprising a street lamp pole, a lamp body and LED bulbs, said lamp body being mounted on the top of said street lamp pole, said LED bulbs being mounted in said lamp body, wherein the LED street lamp further comprises a power supply adapter having a first output end and a first input end, and a constant current actuating device having a second output end and a second input end, and wherein the LED street lamp further comprises an over heat thermostat mounted in said lamp body, and said over heat thermostat is mounted between the first output end of said power supply adapter and the second input end of said constant current actuating device, characterized in that, the lamp body comprises a head portion, a middle portion and a tail portion; said head portion and one side of said middle portion are connected butt and butt, and the opposite side of said middle portion and said tail portion are connected in the same way; a first packing washer is provided between the head portion and the middle portion, and the head portion and the middle portion are secured by fasteners; a second packing washer is provided between the tail portion and the middle portion, and the tail portion and the middle portion are secured by another fasteners;

the middle portion is a profile having a same cross section in different positions along its length direction; said profile consists of a basal plate and said basal plate is tabulated and extends along the length of said profile; said basal plate has a back side and a front side; two side plates are each mounted on each of two edges of said front side, and there are a plurality of heat dissipation wings mounted on said back side;

the LED bulbs are mounted on a side of heat conducting bottom-board, which forms a LED array board, and a printed circuit is mounted on said heat conducting bottom-board; the other side of said heat conducting bottom-board which has no LED bulb is dinged to said front side of said basal plate of middle portion of said lamp body;

the LED street lamp further comprises a secondary optical lens; said secondary optical lens is mounted on a lens bottom-board; said lens bottom-board is parallel to the LED array board; each said LED bulb is corresponding to one said secondary optical lens; there are support units having the same height mounted on the side of said lens bottom-board facing to the LED array board; said heat conducting bottom-board is supported by said support units; said lens bottom-board and said heat conducting bottom-board are connected to the front side of said basal plate with fastener;

a first cross member is mounted on said head portion at the end connecting with said middle portion; a second cross member is mounted on the tail portion at the end connecting with said middle portion; said first cross member, second cross member, said side plate, and the front side of said middle portion together define a chamber; the front side of said middle portion form the bottom of said chamber; said first cross member, second cross member, and said two side plates form walls of said chamber: a step used for placing a lamp-chimney is mounted on the other end of the walls of the chamber which is opposite to the bottom; a tube is mounted on said head portion; the axis of said tube is vertical to said first cross member; a outlet hole leading into said tube is mounted on said first cross member; a threaded hole running through the tube wall is mounted on the side wall of said tube;

said head portion, middle portion and tail portion are all made of heat-conducting material;

said LED street lamp further comprises a lamp-chimney; said lamp-chimney is mounted on said step; a third packing washer is mounted between said lamp-chimney and the lamp body; the LED array board comprises a plurality of LED subsidiary array boards; a group of LED lamps are mounted on each LED subsidiary array board; each LED subsidiary array board is connected on the front side of said basal board of the middle portion with fastener; and correspondingly, the lens bottom-board also comprises a plurality of subsidiary lens bottom-boards; a group of quadratic optical lenses are mounted on each subsidiary lens bottom-board; each subsidiary lens bottom-board is connected on the front side of said basal board of middle portion with fastener; said constant current actuating device is mounted on the middle portion closer to the head portion of the lamp body, and the heat-actuated device of the over heat thermostat is mounted on the heat conducting bottom-board.

* * * * *